US007293970B2

(12) United States Patent
Sato

(10) Patent No.: US 7,293,970 B2
(45) Date of Patent: Nov. 13, 2007

(54) TWO-STAGE ROTARY COMPRESSOR

(75) Inventor: Kazuya Sato, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 101 days.

(21) Appl. No.: 11/065,205

(22) Filed: Feb. 24, 2005

(65) Prior Publication Data

US 2005/0191198 A1 Sep. 1, 2005

(30) Foreign Application Priority Data

Feb. 27, 2004 (JP) ..... 2004-054026
Feb. 27, 2004 (JP) ..... 2004-054031

(51) Int. Cl.
*F01C 21/04* (2006.01)
*F04C 23/00* (2006.01)

(52) U.S. Cl. ..... 418/100; 418/5; 418/60; 418/63; 184/6.18

(58) Field of Classification Search ..... 418/63, 418/60, 5, 9, 94, 55.6, 97, 90, 206.8, 100; 184/61.8, 6.18
See application file for complete search history.

(56) References Cited

U.S. PATENT DOCUMENTS

RE30,994 E * 7/1982 Shaw ..... 417/366
4,487,562 A * 12/1984 Inagaki et al. ..... 418/84
5,322,424 A * 6/1994 Fujio ..... 418/11
5,518,381 A * 5/1996 Matsunaga et al. ..... 418/100
5,545,021 A * 8/1996 Fukuoka et al. ..... 418/63
5,564,917 A * 10/1996 Leyderman et al. ..... 418/63
5,616,017 A 4/1997 Iizuka et al.
6,099,279 A 8/2000 Kohsokabe et al.
6,210,130 B1 * 4/2001 Kakuda et al. ..... 417/363
6,318,981 B1 * 11/2001 Ebara et al. ..... 418/11
6,581,408 B1 * 6/2003 Tadano et al. ..... 62/513
2002/0033295 A1 * 3/2002 Korenjak et al. ..... 180/292
2004/0116009 A1 * 6/2004 Tawa et al. ..... 440/88 J

FOREIGN PATENT DOCUMENTS

EP 1209357 A 5/2002
EP 1284366 A 2/2003
EP 1312880 5/2003
JP 2294587 12/1990
JP 08247062 9/1996
JP 2000104688 4/2000
JP 2003 097479 4/2003

* cited by examiner

*Primary Examiner*—Thomas Denion
*Assistant Examiner*—Mary A Davis
(74) *Attorney, Agent, or Firm*—Weingarten, Schurgin, Gagnebin & Lebovici LLP

(57) ABSTRACT

An oil supply hole connecting an oil reservoir to a suction port formed in a lower supporting member of a two-stage rotary compressor is disclosed. The suction port is provided in the lower supporting member attached to the lower side of a high stage side rotary compressing element, and a necessary amount of oil is supplied into return refrigerant gas sucked into the high stage side rotary compressing element through this oil supply hole. Thus an outer circumferential surface of a roller, which eccentrically rotates in a cylinder, is lubricated to protect it from wear.

6 Claims, 6 Drawing Sheets

TWO-STAGE ROTARY COMPRESSOR

This application claims priority to two patent applications as follows: Japanese application No. 2004-054026 filed Feb. 27, 2004; and Japanese application No. 2004-054031 filed Feb. 27, 2004.

BACKGROUND OF THE INVENTION

1. Technical Field

The present invention relates to a two-stage rotary compressor, and more specifically relates to a two-stage rotary compressor having features in a structure for supplying a rotary compressing element with oil and in a gas seal structure in a muffling chamber provided in relation to the rotary compressing element.

2. Related Art

A two-stage rotary compressor including a motor-drive element in a closed vessel and a rotary compressing element driven by this motor-drive element has been known. For example, a two-stage rotary compressor shown in FIG. 5 will be described. In FIG. 5, an upper portion in a closed vessel A is provided with a motor-drive element B composed of a stator and a rotor, the rotor is attached to an upper end portion of a rotating shaft C, a lower portion in the closed vessel A is provided with a rotary compressing element G composed of a low stage side rotary compressing element E and a high stage side rotary compressing element F through a partition plate D, and supporting members H and I are attached to upper and lower portions of the rotary compressing element G respectively. Each of the low stage side rotary compressing element E and the high stage side rotary compressing element F includes a disc-shaped cylinder J and a roller K, which rotates on the inside of the cylinder eccentrically. These rollers K are fitted on eccentric portions L provided on the rotating shaft C respectively. Further, a low pressure chamber and a high pressure chamber are respectively formed in the cylinders J by the fact that a vane biased with a spring not shown always abuts on an outer circumferential surface of the roller K. The upper and lower supporting members H and I are provided with bearing portions M and N at the center portions respectively, and support the rotating shaft C. Muffling chambers P and Q are respectively provided so as to surround outer circumferences of the bearing portions M and N, and cover plates R and S for closing the opening surfaces of the muffling chambers P and Q are respectively attached.

When a low pressure refrigerant gas is introduced through a lead-in pipe T connected to the closed vessel, this low pressure refrigerant gas is sucked into a suction port in the lower supporting member I and sucked from this suction port to the low pressure chamber in the cylinder J of the low stage side rotary compressing element E where the refrigerant gas is compressed to an intermediate pressure by eccentric rotation of the roller K. The refrigerant gas compressed to the intermediate pressure is discharged from the high pressure chamber of the cylinder J to the muffling chamber Q in the lower supporting member I, and further it passes through a passage (not shown) communicating with the muffling chamber Q to be discharged into the closed vessel A. The intermediate pressure refrigerant gas discharged into the closed vessel A is then taken out of a discharge opening Z of the closed vessel A to the outside and cooled. After that the refrigerant gas is sucked into a suction port provided in the upper supporting member H from a return lead-in pipe U, and is sucked into the low pressure chamber in the cylinder J of the high stage side rotary compressing element F, where it is compressed to high pressure by eccentric rotation of the roller K. This refrigerant gas compressed to the high pressure is discharged from the high pressure chamber to a muffling chamber P in the upper supporting member H and is discharged from a discharge port communicating with the muffling chamber P to the outside of the closed vessel A through a lead-out pipe V connected to the closed vessel A.

Then the high pressure refrigerant gas discharged to the outside of the closed vessel A is supplied to for example a gas cooler in a refrigeration cycle in an air conditioner or the like, and after cooling the refrigerant gas by the gas cooler, it is pressure-reduced by an expansion valve and vaporized by an evaporator. Then the refrigerant gas passes through an accumulator to be returned from the lead-in pipe T to the compressor. The thus formed two-stage rotary compressors have been disclosed in for example Japanese Laid-Open Patent Publications No. 2003-97479 and No. H02-294587 etc.

In the conventional two-stage rotary compressors, two problems to be solved are pointed out. The first problem in these problems to be solved is with a structure of supplying a rotary compressing element with oil.

In the conventional two-stage rotary compressor, a bottom portion in the closed vessel A forms an oil reservoir, oil is pumped up from the oil reservoir with an oil pump W attached to a lower end portion of the rotating shaft C to be raised along the inner surface of a hole provided along the axial direction of the rotating shaft C, and then the oil is oozed out of small holes provided at appropriate portions of the rotating shaft C to an outer surface of the rotating shaft to lubricate bearing portions M and N in the upper and lower supporting members H and I and rotating portions of the low stage side compressing element E and high stage side compressing element F so that sliding portions are lubricated. To be liable to ooze the oil from the small holes of the rotating shaft C upon the lubrication, a vent hole X, which communicates with the outer circumferential surface of the partition plate D through the inner hole (rotating shaft C is penetrated therethrough) formed in the partition plate D, is provided.

Further, as shown in FIG. 5, the partition plate D is provided with an oil supply hole Y, which communicates the vent hole X with a passage (which connects the suction port formed in the upper supporting member H to an inlet of the low pressure chamber in the cylinder J) formed in the cylinder J in the high stage side rotary compressing element F, so that a part of oil contained in gas, which passes through the vent hole X, is supplied to a passage side of the cylinder J. The oil supplied to the passage side of the cylinder J flows into the low pressure chamber together with refrigerant gas, which passes through this passage, and lubricates the sliding portion of the roller K, which rotates eccentrically along the inner circumferential surface of the inside of the cylinder.

However, since the partition plate D is formed thinly in its plate thickness and the oil supply hole Y is provided on a portion of the vent hole X having a thinner plate thickness, the length of the oil supply hole Y cannot be lengthened and a diameter of the oil supply hole Y cannot be increased. Accordingly, an amount of oil supplied to the inside of the cylinder J in the high stage side rotary compressing element F becomes excessive. If the amount of supply oil is excessive (amount of oil more than needed), the performance of lubrication is lowered and a discharge amount of oil becomes excessive by an increased in input due to oil compression or the like.

In the low stage side rotary compressing element E, a low-pressure refrigerant gas is introduced through the lead-in pipe T. Although oil in the refrigerant gas is separated by an accumulator before this lead-in of the refrigerant gas, a considerable amount of oil is still contained in the refrigerant gas. Thus, the low pressure refrigerant gas containing a large amount of oil is introduced into a suction port of the lower supporting member I through the lead-in pipe T, and the refrigerant gas is sucked into a low pressure chamber of the cylinder J through a passage formed in the cylinder J of the low stage side rotary compressing element E. Thus an appropriate amount of oil is supplied to the inside of the cylinder J of the low stage side rotary compressing element E. Further, oil on the inner diameter side of the roller is supplied from a gap between the end surfaces of the rollers.

In the present invention it is intended to solve the first problem of the above-mentioned prior art, or to specifically provide a two stage rotary compressor, which can supply a necessary amount of oil into a cylinder of a high stage side rotary compressing element.

The second problem of problems to be solved in conventional two stage rotary compressors is a gas seal structure of a muffling chamber provided in connection with a rotary compressing element.

Although the conventional two stage rotary compressor supports the rotating shaft C on the upper supporting member H and the lower supporting member I, the upper supporting member H is positioned near the motor-drive element B and supports the vicinity of an upper end portion of the rotating shaft C, which journals a rotor of the motor-drive element B. Thus a load imposed on a bearing portion M becomes larger than a load imposed on the lower supporting member I, which supports a lower end portion of the rotating shaft C. Therefore, the bearing portion M of the upper supporting member H is formed longer than the bearing portion N of the lower supporting member I and is reinforced by fitting a bushing X0 inside the bearing portion M.

Since high pressure refrigerant gas compressed by the high stage side rotary compressing element F is discharged into a muffling chamber P in the upper supporting member H, high accuracy seal properties are required so that no leak is caused between an opening surface of the muffling chamber P and a cover plate R, which closes the opening. Accordingly, between an outer circumference of the bearing portion M in the upper supporting member H and an inner circumferential surface of the center hole in the cover plate R is attached an O ring W0 and in a connection portion between the upper supporting member H and the cover plate R is interposed a gasket Y0. Further, in a case where the upper supporting member H is formed of a ferrous sintered material, in order to improve gas seal properties it is necessary to apply cutting work to an upper end surface of the upper supporting member H to improve the flatness whereby the degree of adhesion to the gasket Y0 is increased.

When the O ring W0 is attached, the outer circumferential surface of the bearing portion M in the upper supporting member H is subjected to a concave grooving work. However, since the wall thickness of the bearing portion M is formed thinly, there are problems that the concave grooving work is troublesome and the working cost is increased. When the wall thickness of the bearing portion M is formed thick a muffling chamber P provided around the outer circumference of the bearing portion M becomes narrow and sufficient space cannot be ensured. Thus, the wall thickness of the bearing portion M must be formed thinly. Although the inner circumferential surface of the center hole in the cover plate P can be subjected to concave grooving work, the concave grooving work is also troublesome, which leads to an increase in working cost.

In the present invention it is intended to solve the conventional second problem or to eliminate the concave grooving work for O ring attachment in the outer circumference of the bearing portion in the upper supporting member and the cutting work in the upper supporting member.

SUMMARY OF THE INVENTION

As a means to solve the first problem, the first aspect of the present invention is a two-stage rotary compressor in which a motor-drive element in a closed vessel and a rotary compressing element driven by said motor-drive element are provided on the upper and lower portions respectively, said two-stage rotary compressor being formed in such a manner that in said rotary compressing element a low stage side rotary compressing element and a high stage side rotary compressing element are positioned on upper and lower sides respectively through a partition plate, an intermediate pressure refrigerant gas compressed by said low stage side rotary compressing element is discharged into said closed vessel, the intermediate pressure refrigerant gas discharged into the closed vessel is taken outside the closed vessel to be cooled and then the intermediate pressure refrigerant gas is supplied to said high stage side rotary compressing element to be compressed to high pressure and the high pressure refrigerant gas is discharged outside said closed vessel, characterized in that said partition plate is provided with a vent hole, a lower supporting member is attached to the lower side of said high stage side rotary compressing element, said lower supporting member being provided with a bearing portion for supporting a lower end portion of a rotating shaft, which is rotated by said motor-drive element at the center of the lower supporting member, a muffling chamber is provided so that said muffling chamber surrounds an outer circumference of the bearing portion, a cover plate for closing an opening surface of said muffling chamber is attached to the lower side of said lower supporting member, and an oil supply hole for communicating with an oil reservoir on a bottom portion of said closed vessel and a suction port formed in said lower supporting member is provided in said lower supporting member.

According to the first aspect of the invention, a high stage side rotary compressing element is positioned on the lower side and an oil supply hole through which oil is supplied to a cylinder of the high stage side compressing element is not provided on a partition plate provided with a vent hole but on a lower supporting member. Accordingly, the size of the oil supply hole is lengthened and the hole diameter can be increased. Thus, the oil supply hole is immersed in the oil reservoir provided in a bottom portion in the closed vessel and sucks oil by utilizing a differential pressure due to the flow rate of refrigerant gas, which flows in a passage formed from a suction port of the lower supporting member to a cylinder of the high stage side rotary compressing element, so that a necessary amount of oil can be supplied to the inside of the cylinder of the high stage side rotary compressing element. Thus, the lubricating properties of a roller, which rotates eccentrically in the cylinder are optimized and the seal properties of the roller against an inner circumferential surface of the cylinder is also optimized whereby the compression performance of the refrigerant gas can be enhanced. Accordingly, the reduction in performance and excessive discharge amount of oil due to oil compression more than needed can be suppressed.

As a means to solve the first problem, in the two-stage rotary compressor of the first or second aspect of the present invention is characterized in that in said oil supply hole the upper end thereof is opened to the suction port of said lower supporting member and the lower end thereof is opened to a gap formed by a gasket interposed between said lower supporting member and said cover plate.

According to the second aspect of the invention, since in the two-stage rotary compressor of the first aspect, in said oil supply hole the upper end thereof is opened to the suction port of said lower supporting member and the lower end thereof is opened to a gap formed by a gasket interposed between said lower supporting member and said cover plate, oil can be communicated with an oil reservoir provided in the bottom portion in the closed vessel through the gap. Therefore machining work of the oil supply hole becomes easy.

As a means to solve the first problem, in the two-stage rotary compressor of the first aspect, the third aspect of the present invention is characterized that in said oil supply hole the upper end thereof is opened to the suction port of said lower supporting member and the lower end thereof is opened to a concave groove formed in a lower end surface of said lower supporting member.

According to the third aspect of the invention, since in the two-stage rotary compressor of claim 1, in said oil supply hole the upper end thereof is opened to the suction port of said lower supporting member and the lower end thereof is opened to a concave groove formed in a lower end surface of said lower supporting member, the concave groove acts as a guide passage to the oil supply hole so that a lead-in rate of oil to the opening of the lower end of the oil supply hole is decreased and a lead-in amount of oil can be reduced.

As a means to solve the first problem, in the two-stage rotary compressor of the first aspect, the fourth aspect of the present invention is characterized in that in said oil supply hole the upper end thereof is opened to the suction port of said lower supporting member and the lower end thereof is opened to a cutout portion formed in a lower end surface of said lower supporting member.

According to the fourth aspect of the invention, since in the two-stage rotary compressor of claim 1, in said oil supply hole the upper end thereof is opened to the suction port of said lower supporting member and the lower end thereof is opened to a cutout portion formed in a lower end surface of said lower supporting member. Therefore, a space of the cutout portion is formed large so that machining work of the cutout portion is facilitated and a sufficient amount of oil can be stored in the cutout portion.

As a means to solve the second problem, the fifth aspect of the present invention is a two-stage rotary compressor in which a motor-drive element in a closed vessel and a rotary compressing element driven by said motor-drive element are respectively provided on the upper and lower portions, said two-stage rotary compressor being formed in such a manner that in said rotary compressing element a low stage side rotary compressing element and a high stage side rotary compressing element are positioned on upper and lower sides respectively, an intermediate pressure refrigerant gas compressed by said low stage side rotary compressing element is discharged into said closed vessel, the intermediate pressure refrigerant gas discharged into the closed vessel is taken outside the closed vessel to be cooled and then the intermediate pressure refrigerant gas is supplied to said high stage side rotary compressing element to be compressed to high pressure and the high pressure refrigerant gas is discharged outside said closed vessel, characterized in that a lower supporting member is attached to the lower side of said high stage side rotary compressing element, said lower supporting member being provided with a bearing portion for supporting a lower end portion of a rotating shaft, which is rotated by said motor-drive element at the center of the lower supporting member, a muffling chamber is provided so that said muffling chamber surrounds an outer circumference of the bearing portion, a cover plate for closing an opening surface of said muffling chamber is attached to the lower side of said lower supporting member, and gas sealing is performed by the fact that a concave groove is provided on a lower end surface of said bearing portion in its circumferential direction to attach an O ring and a gasket is interposed in a connection portion between said lower supporting member and said cover plate.

According to the fifth aspect of the invention, since the high stage side rotary compressing element is provided on the low side so that the low stage side and the high stage side of a rotary compressing element provided in a closed vessel are reversed, an O ring can be attached by subjecting a lower end surface of thick-walled and short-sized bearing portion in a lower supporting member corresponding to the high stage side rotary compressing element to concave grooving work. Thus the concave grooving work can be easily performed and the working cost can be reduced. Further, since a gasket is interposed in a connection portion between the lower supporting member and the cover plate, which closes an opening surface of the muffling chamber in the lower supporting member, high accuracy gas seal properties against high pressure refrigerant gas can be realized in cooperation with the O ring. Further, since intermediate pressure refrigerant gas compressed by the low stage side rotary compressing element is discharged into the closed vessel, the gas seal properties between the upper supporting member corresponding to the low stage side compressing element and the cover plate, which closes the opening surface in the muffling chamber in the upper supporting member may not be in high accuracy. Accordingly, concave grooving work in an outer circumference of the thin-walled and long-sized bearing portion in the upper supporting member can be eliminated.

As a means to solve the second problem, the sixth aspect of the present invention is a two-stage rotary compressor in which a motor-drive element and a rotary compressing element driven by said motor-drive element are provided on the upper and lower portions respectively in a closed vessel, said two-stage rotary compressor being formed in such a manner that in said rotary compressing element a low stage side rotary compressing element and a high stage side rotary compressing element are positioned on the lower and upper sides respectively, an intermediate pressure refrigerant gas compressed by said low stage side rotary compressing element is discharged to the outside of said closed vessel to be cooled, then the refrigerant gas is supplied to said high stage side rotary compressing element to be compressed to high pressure, the high pressure refrigerant gas is discharged into said closed vessel and then the high pressure refrigerant gas discharged into the closed vessel is taken outside the closed vessel, characterized in that a lower supporting member is attached to the lower side of said low stage side rotary compressing element, said lower supporting member being provided with a bearing portion for supporting a lower end portion of a rotating shaft, which is rotated by said motor-drive element at the center of the lower supporting member, a muffling chamber is provided so that said muffling chamber surrounds an outer circumference of the bearing portion, a cover plate for closing an opening surface of said muffling chamber is attached to the lower side of said lower supporting member, and a gas sealing is performed by the fact that a concave groove is provided on a lower end surface of said bearing portion in its circumferential direction to attach an O ring and a gasket is interposed in a connection portion between said lower supporting member and said cover plate.

According to the sixth aspect of the invention, since the high stage side rotary compressing element is provided on the upper side so that the low stage side and the high stage side of a rotary compressing element provided in a closed vessel are not reversed and high pressure refrigerant gas compressed by the high stage side rotary compressing element is discharged into the closed vessel, the gas seal properties between the upper supporting member corresponding to the high stage side rotary compressing element and the cover plate, which closes an opening surface in the muffling chamber in the upper supporting member may not be in high accuracy. Accordingly, concave grooving work in an outer circumference of the thin-walled and long-sized bearing portion in the upper supporting member can be eliminated. The gas sealing between the lower supporting member corresponding to the low stage side rotary compressing element and the cover plate, which closes an opening surface of the muffling chamber in the lower supporting member is performed by attaching an O ring by subjecting a lower end surface of a thick-walled and short-sized bearing portion in the lower supporting member to concave grooving work and by interposing a gasket in a connection portion between the lower supporting member and the cover plate, so that high accuracy gas seal properties can be realized. Accordingly, the concave grooving work can be easily performed and the working cost can be reduced.

As a means to solve the second problem, in the two-stage rotary compressor of the fifth or sixth aspect, the seventh aspect of the present invention is characterized in that a step is previously provided between the lower end surface of the bearing portion in said lower supporting member and the lower end surface of said lower supporting member, and a gasket is sandwiched in the step portion by setting the size of the step at the same as the thickness of said gasket or at a slightly smaller than that.

According to the seventh aspect of the invention, since in the two-stage rotary compressor of the fifth or sixth aspect, a step of the same thickness as the gasket or slightly smaller than that is previously provided, the gasket can be sandwiched at the step portion. Accordingly, it is not necessary to apply cutting work to the lower end surface of the lower supporting member and working cost reduction can be performed. Further, the provision of the step portion improves the seal properties and durability of the O ring.

THE PREFERRED EMBODIMENTS OF THE INVENTION

Preferred embodiments of the present invention will be described with reference to drawings. First, an embodiment in which an oil supply structure according to the present invention is applied to an internal intermediate pressure type two-stage rotary compressor will be described by use of FIGS. 1 to 4.

Figure 1:
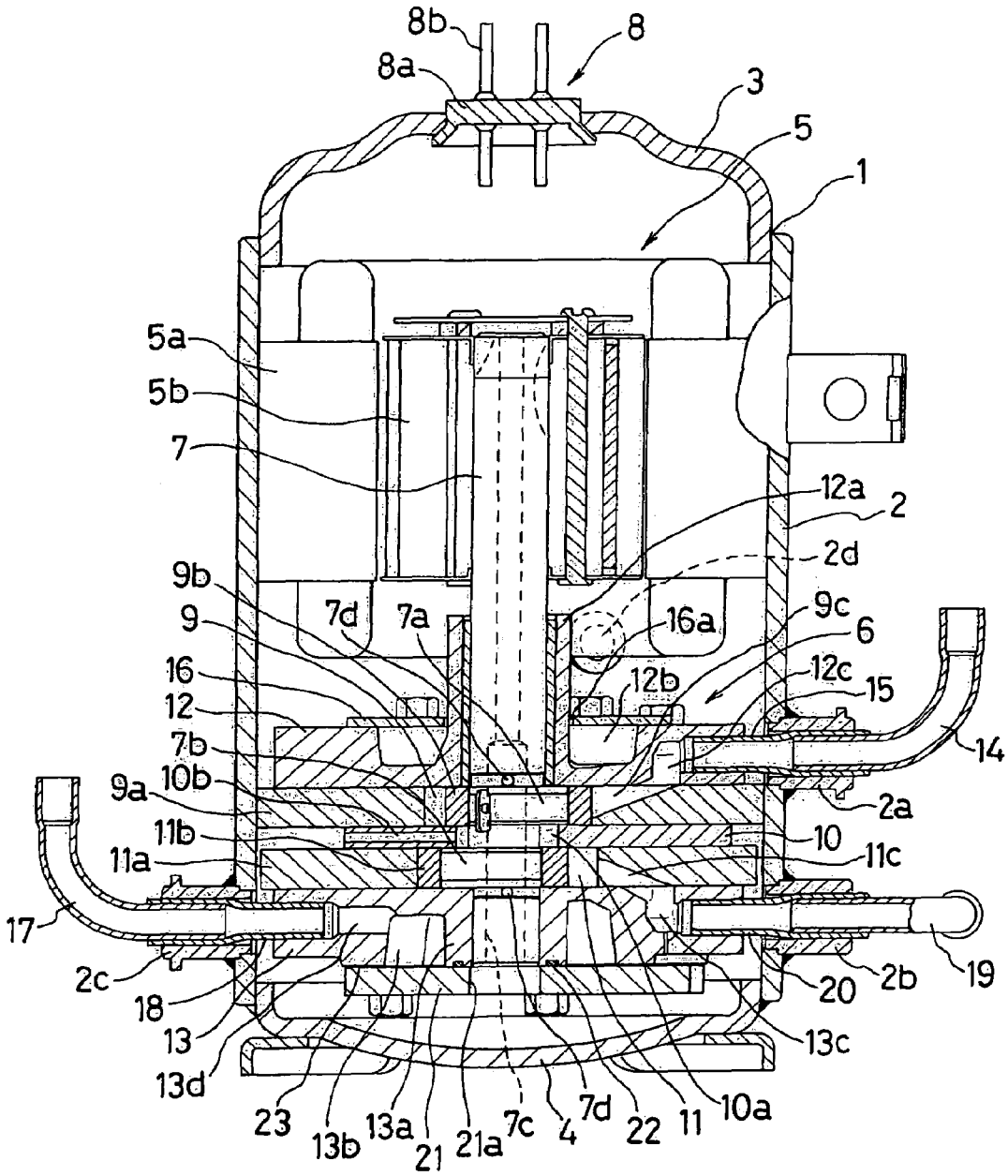
FIG. 1 is a schematic cross-sectional view showing an embodiment in which an oil supply structure according to the present invention is applied to an internal intermediate pressure type two-stage rotary compressor.

In FIG. 1, the reference numeral 1 is a closed vessel. The closed vessel 1 is comprised of a cylindrical vessel 2 and end caps 3, 4 attached to opening end portions of the vessel 2, and is provided in such a manner that a motor-drive element 5 and a rotary compressing element 6 are positioned at upper and lower portions in this closed vessel 1.

The motor-drive element 5 is comprised of an annular stator 5*a* fixed to an inner surface of the vessel 2 and a rotor 5*b*, which rotates inside the stator 5*a*. The rotor 5*b* is journaled on an upper end portion of a rotating shaft 7. This motor-drive element 5 rotates the rotor 5*b* by current feed to the stator 5*a* through a terminal 8 attached to the end cap 3.

The terminal 8 is comprised of a base 8*a* fixed to an mounting hole of the end cap 3 and a plurality of connecting terminals 8*b* provided on the base 8*a* while penetrating through an electrical insulating material such as glass, synthetic resin. Although not shown, lower end portions of the connecting terminals 8*b* are connected to the stator 5*a* of the motor-drive element 5 through internal lead wires, and upper end portions of the connecting terminals 8*b* are connected to an external power source through external lead wires.

The rotary compressing element 6 is comprised of a low stage side rotary compressing element 9 and a high stage side compressing element 11 provided under the low stage side rotary compressing element 9 through a partition plate 10. In the rotary compressing element 6, the upper and lower positions are reversed to conventional general two-stage rotary compressing element by providing the high stage side rotary compressing element 11 on the lower side of the low stage side rotary compressing element 9. The low stage side rotary compressing element 9 includes a cylinder 9*a* and a roller 9*b*, which rotates eccentrically while being fitted to a low stage side eccentric portion 7*a* provided on the rotating shaft 7. Also, the high stage side rotary compressing element 11 includes a cylinder 11*a* and a roller 11*b*, which rotates eccentrically while being fitted to a high stage side eccentric portion 7*b* provided on the rotating shaft 7.

A vane biased by spring not shown always abuts on an outer circumferential surface of the roller 9*b* of the low stage side rotary compressing element 9 so that the inside of the cylinder 9*a* is defined to a low pressure chamber and a high pressure chamber. Also a vane biased by a spring always abuts on an outer circumferential surface of the roller 11*b* of the high stage side rotary compressing element 11 so that the inside of the cylinder 11*a* is defined to a low pressure chamber and a high pressure chamber. It is noted that the low stage side eccentric portion 7*a* provided on the rotating shaft 7 and the high stage side eccentric portion 7*b* are shifted by a phase of 180° to each other.

Further, on the low stage side rotary compressing element 9 is provided an upper supporting member 12 and below the high stage side rotary compressing element 11 is provided a lower supporting member 13. The upper supporting member 12 and the lower supporting member 13 are integrally fixed to each other by a plurality of through bolts with the low stage side rotary compressing element 9, the partition plate 10 and the high stage side rotary compressing element 11 sandwiched therebetween. It is noted that a through hole 10*a* is opened in the partition plate 10 and the rotating shaft 7 is penetrated through the through hole 10*a*. Further a vent hole 10*b*, which communicates with the outer circumferential surface of the partition plate 10 through the through hole 10*a*, is provided.

The upper supporting member 12 has a bearing portion 12*a* at the center. The bearing portion 12*a* is formed to be thin in wall thickness and long in size, and fits a sleeve inside to support the rotating shaft 7. On the upper surface side of the upper supporting member 12 is provided a muffling chamber 12*b* along the outer circumference of the bearing portion 12*a*, and the muffling chamber 12*b* communicates with an outlet of a high pressure chamber in the cylinder 9*a* of the low stage side rotary compressing element 9, and at the same time it communicates with a discharge port (not shown) formed in the upper supporting member 12. This discharge port communicates with the inside of the closed vessel 1. Further, a suction port 12*c* is provided in the upper supporting member 12. The suction port 12*c* communicates with an inlet of a low pressure chamber through a passage 9*c* formed in the cylinder 9*a* and at the same time communicates with a refrigerant gas lead-in pipe 14 connected to a lead-in opening 2*a* of the vessel 2 through a sleeve 15. Further, a cover plate 16 is fixed onto an upper surface of the upper supporting member 12 with bolts to close an opening surface of the muffling chamber 12*b*, and the cover plate 16 has a through hole 16*a* at the center through which the bearing portion 12*a* penetrates.

The lower supporting member 13 has a bearing portion 13*a* at the center, and the bearing portion 13*a* supports a lower end portion of the rotating shaft 7. On the lower surface side of the lower supporting member 13 is provided a muffling chamber 13*b* along the outer circumference of the bearing portion 13*a*, and the muffling chamber 13*b* communicates with an outlet of a high pressure chamber in the cylinder 11*a* of the high stage side rotary compressing element 11, and at the same time it communicates with a discharge port 13*d* formed in the lower supporting member 13. This discharge port 13*d* communicates with a refrigerant gas lead-out pipe 17 connected to the lead-out opening 2*c* of the vessel 2 through a sleeve 18. Further, a suction port 13*c* is provided in the lower supporting member 13. The suction port 13*c* communicates with an inlet of a low pressure chamber through a passage 11*c* formed in the cylinder 11*a* and at the same time communicates with a refrigerant gas return lead-in pipe 19 connected to a return lead-in opening 2*b* of the vessel 2 through a sleeve 20. Further, a cover plate 21 is fixed onto a lower surface of the lower supporting member 13 with bolts to close an opening surface of the muffling chamber 13*b*, and the cover plate 21 has a through hole 21*a* at the center.

Further a concave groove is provided on a lower end surface of the bearing portion 13*a* of the lower supporting member 13 in the circumferential direction to attach an O ring 22 to the groove, and an annular gasket 23 is interposed in a connection portion between the lower end surface of the lower supporting member 13 in an outer circumferential portion of the muffling chamber 13*b* and the cover plate 21. As the gasket 23 a metallic gasket is used, but the gasket is not limited thereto and other materials may be used. It is noted that in the present embodiment an oil pump is not attached to a lower end portion of the rotating shaft 7.

Figure 2:
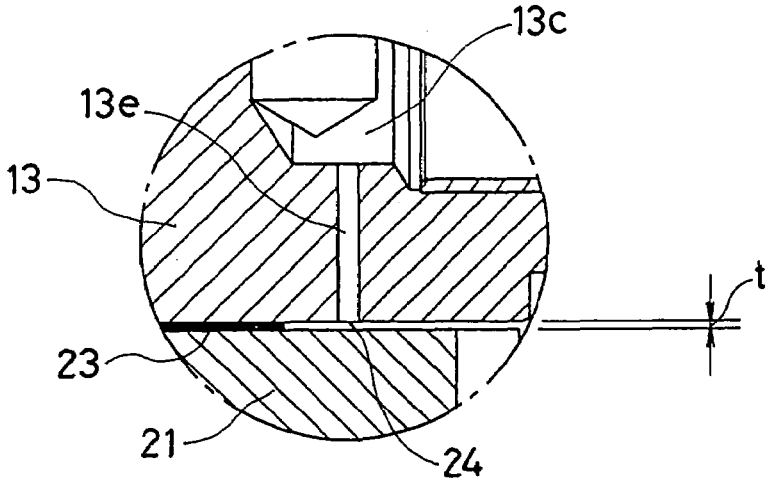
FIG. 2 is a partial perspective view showing details of an oil supply means provided in a lower supporting member in an embodiment in which an oil supply structure according to the present invention is applied to an internal intermediate pressure type two-stage rotary compressor.

In this embodiment, as shown in FIG. 2, an oil supply hole 13*e* (inner diameter is for example 1.5 mm) is provided in the lower supporting member 13. An upper end of the oil supply hole 13*e* is opened in the suction port 13*c* formed in the lower supporting member 13, and a lower end of the oil supply hole 13*e* is opened in the gap 24 between the lower supporting member 13 and the cover plate 16. This gap 24 is a small gap formed by the thickness t (for example t=0.3 mm) of the gasket 23, which is interposed in the connection portion between a lower end surface of the lower supporting member 13 and the cover plate 21. Accordingly, the oil supply hole 13*e* communicates with an oil reservoir (not shown) in a bottom portion in the closed vessel 1 through the gap 24. Since this oil supply hole 13*e* can be more lengthened in size than an oil supply hole provided in a conventional partition plate, the diameter of the hole can be formed large.

Figure 3:
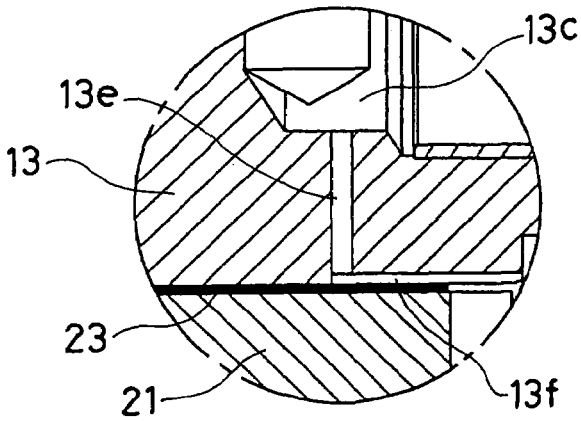
FIG. 3 is a partial perspective view showing another embodiment an oil supply means provided in a lower supporting member in an embodiment in which an oil supply structure according to the present invention is applied to an internal intermediate pressure type two-stage rotary compressor.

As shown in FIG. 3, the oil supply hole 13*e* and the oil reservoir may be communicated with each other by providing a concave groove 13*f* (for example 0.5 mm in height) on a lower surface of the lower supporting member 13 and connecting the concave groove 13*f* to the oil supply hole 13*e*. The concave groove 13*f* acts as a guide passage to the oil supply hole 13*e*. Such a structure is effective in case where a lower end of the oil supply hole 13*e* is closed by the gasket 23 interposed in the connection portion between the lower end surface of the lower supporting member 13 and the cover plate 21 so that a gap is not formed.

Figure 4:
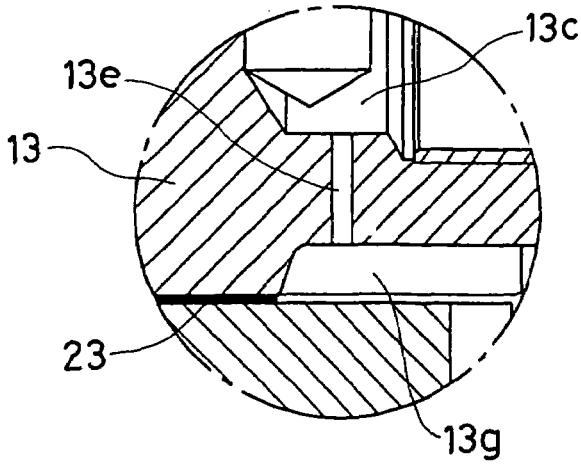
FIG. 4 is a partial perspective view showing still another embodiment an oil supply means provided in a lower supporting member in an embodiment in which an oil supply structure according to the present invention is applied to an internal intermediate pressure type two-stage rotary compressor.
Figure 5:
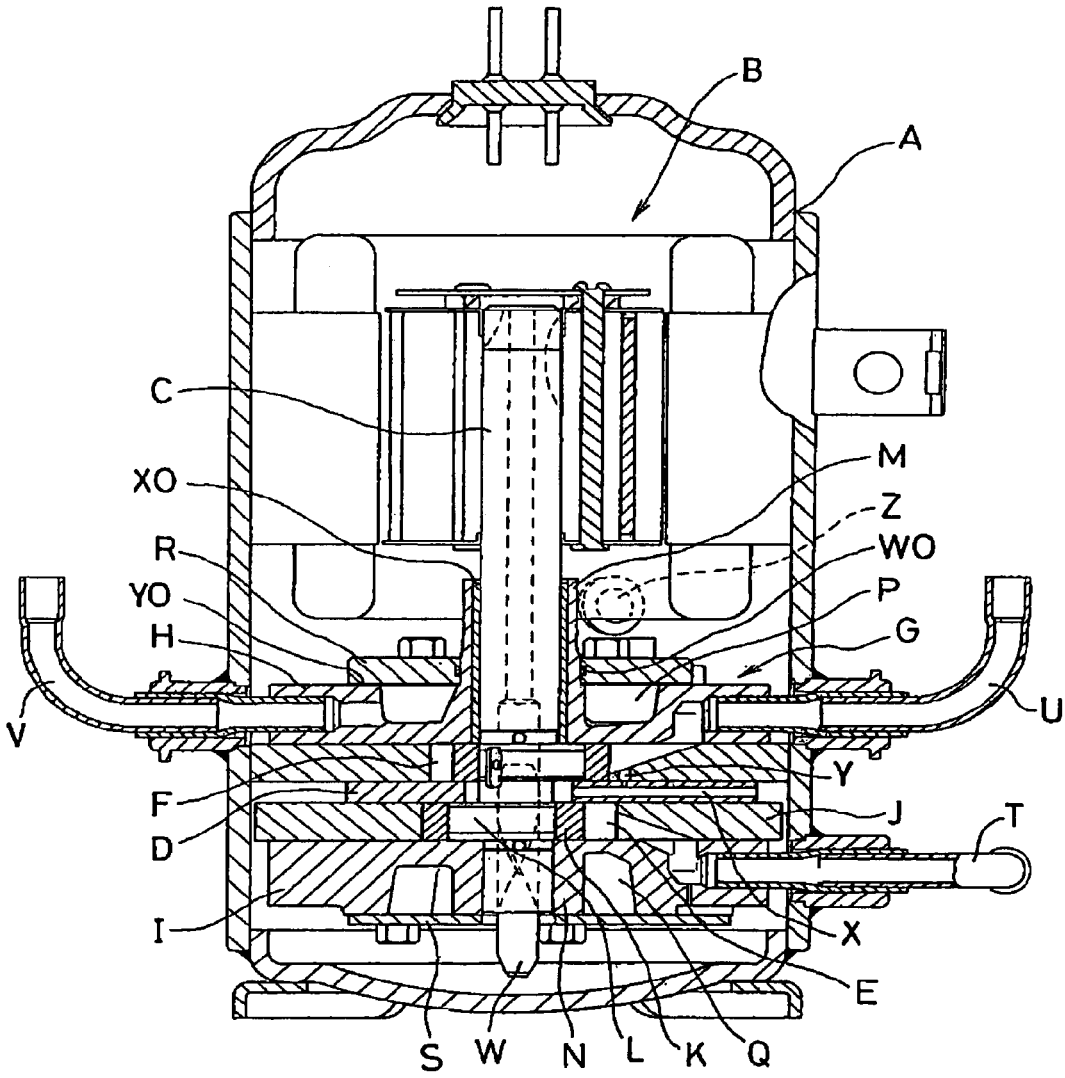
Fig. 5 PRIOR ART
FIG. 5 is a schematic cross-sectional view showing an example of a conventional internal intermediate pressure type two-stage rotary compressor.

Further, as shown in FIG. 4, the oil supply hole 13*e* and the oil reservoir may be communicated with each other by providing a cutout portion 13*g* (for example 3 mm in height) on a lower surface of the lower supporting member 13 and connecting the cutout portion 13*g* to the oil supply hole 13*e*. The cutout 13*g* acts as a lead-in opening to the oil supply hole 13*e*. Such a structure can be applied to both cases where a gap is formed by the gasket 23 and a gap is not formed. Since the cutout portion 13*g* can form large space, the machining work of the cutout portion 13*g* becomes easy and a sufficient amount of oil can be reserved in the cutout portion 13*g*.

Actions of the thus formed internal intermediate pressure type two-stage rotary compressor will be described. When the stator 5*a* of the motor-drive element 5 is energized through the terminal 8, the rotor 5*b* is rotated and the rotary compressing element 6 is driven by the rotation of the rotor 5*b* as well as the rotating shaft 7. When low pressure refrigerant gas is introduced through the refrigerant gas lead-in pipe 14 connected to the closed vessel 1, the low pressure refrigerant gas is sucked to the suction port 12*c* of the upper supporting member 12 and passes through the passage 9*c* formed in the cylinder 9*a* of the low stage side rotary compressing element 9 to be sucked into the low pressure chamber, and the low pressure refrigerant gas is compressed to intermediate pressure by eccentric rotation of the roller 9*b*. The refrigerant gas compressed to the intermediate pressure is discharged to the muffling chamber 12*b* in the upper supporting member 12 from the high pressure chamber in the cylinder 9*a* and is discharged to the inside of the closed vessel 1 through a discharge port (not shown) communicating with the muffling chamber 12*b*.

The intermediate pressure refrigerant gas discharged into the closed vessel 1 is sent to a cooler (not shown) through a discharge pipe (not shown) connected to the discharge opening 2*d* (FIG. 1) formed in the vessel 2 and is cooled in the cooler. After that the intermediate pressure refrigerant gas is taken out of the closed vessel 1 through the refrigerant gas return lead-in pipe 19 and is led to the suction port 13*c* in the lower supporting member 13. The refrigerant gas led in the suction port 13*c* passes through the passage 11*c* formed in the cylinder 11*a* of the high stage side rotary compressing element 11 to be sucked in the low pressure chamber, and is compressed to high pressure by eccentric rotation of the roller 11*b*. The refrigerant gas compressed to high pressure is discharged to the muffling chamber 13*b* in the lower supporting member 13 from the high pressure chamber in the cylinder 11*a* and is discharged from the discharge port 13*d* communicating with the muffling chamber 13*b* to the outside of the closed vessel 1 through the refrigerant gas lead-out pipe 17.

Then the high pressure refrigerant gas discharged outside the closed vessel 1 is supplied to for example a gas cooler in a refrigeration cycle such as an air-conditioner (not shown) and cooled by the gas cooler. After that the refrigerant gas is pressure reduced by an expansion valve and is evaporated by an evaporator, and then it passes through an accumulator and is returned to the compressor from the refrigerant gas lead-in pipe 14.

In the action of the above-mentioned internal intermediate pressure type two-stage rotary compressor, there is an oil reservoir at the bottom portion in the closed vessel 1, and the top surface of the oil reservoir has such a level that the lower supporting member 13 is substantially buried. The hole 7*c* is formed inside the rotating shaft 7 in the axial direction, and oil in the oil reservoir is lifted by the rotation of the rotating shaft 7 along the inner surface of the hole in the rotating shaft 7 to ooze out from small holes 7*d* provided in a plurality of the portions of the rotating shaft 7 to the outer surface of the rotating shaft 7. The oil oozed out from the small holes 7*d* lubricates the outer circumferential surface of the rotating shaft 7 in the bearing portion 13*a* of the lower supporting member 13, the bearing portion 12*a* of the upper supporting member 12, the low stage side eccentric portion 7*a* and the high stage side eccentric portion 7*b*, and protects them from wear. At this time the vent hole 10*b* of the partition plate 10 releases the gas around the rotating shaft 7 laterally whereby oil is liable to ooze from the small holes 7*d* of the rotating shaft 7.

Further, in the low stage side rotary compressing element 9, low pressure refrigerant gas is introduced from the refrigerant gas lead-in pipe 14 to the suction port 12*c* of the upper supporting member 12. A large amount of oil is contained in the refrigerant gas. Since the refrigerant gas is sucked to the low pressure chamber through the passage 9*c* formed in the cylinder 9*a* in the low stage side rotary compressing element 9, it lubricates the outer circumferential surface of the roller 9*b*, which eccentrically rotates in the cylinder 9*a*, and protects the surface from wear, and at the same time the gas seal properties between the inner circumferential surface of the cylinder 9*a* and the outer circumferential surface of the roller 9*b* are increased whereby the compression efficiency of the refrigerant gas can be enhanced.

The intermediate pressure refrigerant gas compressed by the low stage side rotary compressing element 9 is discharged into the closed vessel 1 as mentioned above and most of oil is separated from the refrigerant gas to drop into the oil reservoir in the closed vessel 1 following the discharge. The intermediate pressure gas refrigerant discharged into the closed vessel 1 is taken out of the discharge opening 2*d* and at the same time cooled by the cooler as mentioned above, and then the refrigerant gas is led from the refrigerant gas return lead-in pipe 19 to the suction port 13*c* of the lower supporting member 13. The oil is not contained so much in this return refrigerant gas. Thus even if the return refrigerant gas passes through the passage 11*c* formed in the cylinder 11*a* in the high stage side rotary compressing element 11 and is sucked into the low pressure chamber, the outer circumferential surface of the roller 11*b*, which eccentrically rotates in the cylinder 11*a* can not be sufficiently lubricated.

In the present embodiment the oil supply hole 13*e* is provided in the lower supporting member 13 as described above, and when the return refrigerant gas flows from the suction port 13*c* to the passage 11*c* formed in the cylinder 11*a* in the high stage side rotary compressing element 11, oil is sucked from the oil reservoir by use of differential pressure due to the flow rate so that a necessary amount of oil can be supplied to the inside of the cylinder 11*a* of the high stage side rotary compressing element 11 through the oil supply hole 13*e*. At this time in case where the lower supporting member 13 has the structure of FIG. 2, oil in the oil reservoir passes through the gap 24 and flows into the oil supply hole 13*e*, and in case where the lower supporting member 13 has the structure of FIG. 3, oil in the oil reservoir flows into the oil supply hole 13*e* using the concave groove 13*f* as a guide passage, and in case where the lower supporting member 13 has the structure of FIG. 4, oil in the oil reservoir flows into the oil supply hole 13*e* through the cutout portion 13*g*. Since the gap 24 or the concave groove 13*f* is narrow as a passage, it can reduce the lead-in rate of oil into the oil supply hole 13*e* and also reduce a lead-in amount of oil. On the other hand, since the cutout portion 13*g* has a large space, a sufficient amount of oil can be reserved in the cutout portion 13*g*.

As described above, a necessary amount of oil can be supplied into return refrigerant gas sucked into the high stage side rotary compressing element 11 through the oil supply hole 13*e* provided in the lower supporting member 13, the outer circumferential surface of the roller 11*b*, which eccentrically rotates inside the cylinder 11 is lubricated to protect the surface from wear, and at the same time the gas seal properties between the inner circumferential surface of the cylinder 11*a* and the outer circumferential surface of the roller 11*b* and between the end surface of the roller 11*b*, the partition plate 10, and the end surface of the cylinder 11*a* are increased so that the compression efficiency of the refrigerant gas can be improved.

Next, an embodiment in which an oil supply structure according to the present invention is applied to an internal intermediate pressure type two-stage rotary compressor will be described by use of FIGS. 6 to 8.

Figure 6:
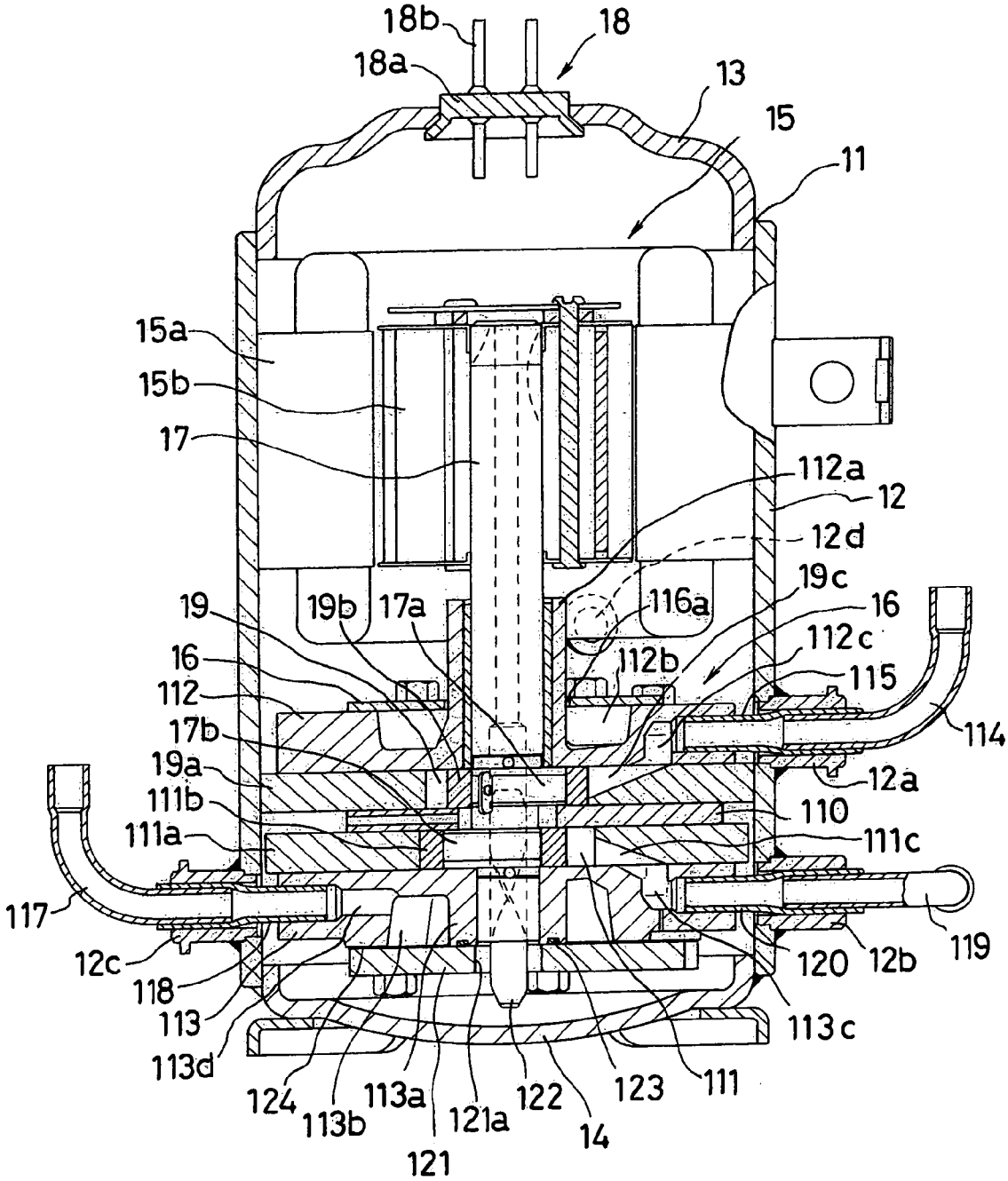
FIG. 6 is a schematic cross-sectional view showing an embodiment in which a gas seal structure according to the present invention is applied to an internal intermediate pressure type two-stage rotary compressor.
Figure 7:
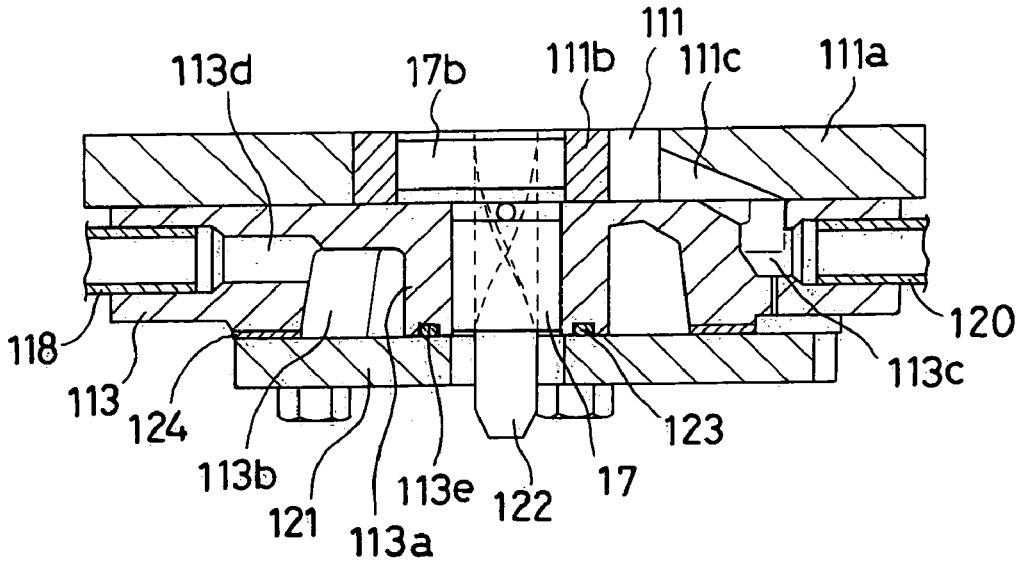
FIG. 7 is a partial cross-sectional view showing a gas seal structure between a lower supporting member and a cover plate in an embodiment in which a gas seal structure according to the present invention is applied to an internal intermediate pressure type two-stage rotary compressor.

In FIG. 6, the reference numeral 11 is a closed vessel. The closed vessel 11 is comprised of a substantially cylindrical vessel 12 and end caps 13, 14 attached to opening end portions of the vessel 12, and is provided with a motor-drive element 15 and a rotary compressing element 16 positioned at upper and lower portions respectively in this closed vessel 11.

The motor-drive element 15 is comprised of an annular stator 15*a* fixed to an inner surface of the vessel 12 and a rotor 15*b*, which rotates inside the stator 15*a*. The rotor 15*b* is journaled on an upper end portion of a rotating shaft 17. This motor-drive element 15 rotates the rotor 15*b* by current feed to the stator 15*a* through a terminal 18 attached to the end cap 13.

The terminal 18 is comprised of a base 18*a* fixed to an mounting hole of the end cap 13 and a plurality of connecting terminals 18*b* provided on the base 18*a* while penetrating through an electrical insulating material such as glass and synthetic resin. Although not shown, a lower end portion of the connecting terminals 18*b* is connected to the stator 15*a* of the motor-drive element 15 through internal lead wires, and an upper end portion of the connecting terminals 18*b* is connected to an external power source through external lead wires.

The rotary compressing element 16 is comprised of a low stage side rotary compressing element 19 and a high stage side rotary compressing element 111 provided under the low stage side rotary compressing element 19 through a partition plate 110. In the rotary compressing element 16, the upper and lower positions are reversed to conventional general two-stage rotary compressing element by providing the high stage side rotary compressing element 111 on the lower side of the low stage side rotary compressing element 19. The low stage side rotary compressing element 19 includes a cylinder 19*a* and a roller 19*b*, which rotates eccentrically while being fitted to a low stage side eccentric portion 17*a* provided on the rotating shaft 17. Also, the high stage side rotary compressing element 111 includes a cylinder 111*a* and a roller 111*b*, which rotates eccentrically while being fitted to a high stage side eccentric portion 17*b* provided on the rotating shaft 17.

A vane biased by spring not shown always abuts on an outer circumferential surface of the roller 19*b* of the low stage side rotary compressing element 19 so that the inside of the cylinder 19*a* is defined to a low pressure chamber and a high pressure chamber. Also a vane biased by a spring always abuts on an outer circumferential surface of the roller 111*b* of the high stage side rotary compressing element 111 so that the inside of the cylinder 111*a* is defined to a low pressure chamber and a high pressure chamber. It is noted that the low stage side eccentric portion 17*a* provided on the rotating shaft 17 and the high stage side eccentric portion 17*b* are shifted by a phase of 180° to each other.

Further, on the low stage side rotary compressing element 19 is provided an upper supporting member 112 and below the high stage side rotary compressing element 111 is provided a lower supporting member 113. The upper supporting member 112 and the lower supporting member 113 are integrally fixed to each other by a plurality of through bolts with the low stage side rotary compressing element 19, the partition plate 110 and the high stage side rotary compressing element 111 sandwiched therebetween.

The upper supporting member 112 has a bearing portion 112*a* at the center. The bearing portion 112*a* is formed to be thin in wall thickness and long in size, and fits a sleeve inside to support the rotating shaft 17. On the upper surface side of the upper supporting member 112 is provided a muffling chamber 112*b* along the outer circumference of the bearing portion 112*a*, and the muffling chamber 112*b* communicates with an outlet of a high pressure chamber in the cylinder 19*a* of the low stage side rotary compressing element 19, and at the same time it communicates with a discharge port (not shown) formed in the upper supporting member 112. This discharge port communicates with the inside of the closed vessel 114. Further, a suction port 112*c* is provided in the upper supporting member 112. The suction port 112*c* communicates with an inlet of a low pressure chamber through a passage 19*c* formed in the cylinder 19*a* and at the same time communicates with a refrigerant gas lead-in pipe 14 connected to a lead-in opening 12*a* of the vessel 12 through a sleeve 115. Further, a cover plate 116 is fixed onto an upper surface of the upper supporting member 112 with bolts to close an opening surface of the muffling chamber 112*b*, and the cover plate 116 has a through hole 116*a* at the center through which the bearing portion 112*a* penetrates.

In the present embodiment, since intermediate pressure refrigerant gas compressed by the low stage side rotary compressing element 19 is discharged into the muffling chamber 112*b* of the upper supporting member 112, high accuracy gas seal properties are not more required as compared with a case where high pressure refrigerant gas compressed by a conventional high stage side rotary compressing element is discharged. Even if intermediate pressure refrigerant gas is slightly gas-leaked from the muffling chamber 112*b* of the upper supporting member 112, since discharged intermediate pressure refrigerant gas is present in the closed vessel 11, any troubles do not occur. Accordingly, it is not necessary to subject an outer circumference of a thin-walled and long-sized bearing portion 112*a* in the upper supporting member 112 to concave grooving work to attach an O ring thereon. Also even if the upper supporting member 112 is formed of a ferrous sintered material, it is not necessary to apply cutting work to the upper end surface of the upper supporting member 112 and interpose a gasket in a connection portion between the upper supporting member 112 and the cover plate 116. Thus, the conventional concave grooving work on the outer circumference of the bearing portion 112*a* and cutting work of the upper supporting member 112 are eliminated whereby working cost reduction can be achieved.

The lower supporting member 113 has a bearing portion 113*a* at the center, and the bearing portion 113*a* is formed more thickly and shorter in size than in the bearing portion 112*a* of the upper supporting member 112 and supports a lower end portion of the rotating shaft 17 without a sleeve fitted inside. On the lower surface side of the lower supporting member 113 is provided a muffling chamber 113*b* along the outer circumference of the bearing portion 113*a*, and the muffling chamber 113*b* communicates with an outlet of a high pressure chamber in the cylinder 111*a* of the high stage side rotary compressing element 111, and at the same time it communicates with a discharge port 113*d* formed in the lower supporting member 113. This discharge port 113*d* communicates with a refrigerant gas lead-out pipe 117 connected to the lead-out opening 12*c* of the vessel 12 through a sleeve 118. Further, a suction port 113*c* is provided in the lower supporting member 113. The suction port 113*c* communicates with an inlet of a low pressure chamber through a passage 111*c* formed in the cylinder 111*a* and at the same time communicates with a refrigerant gas return lead-in pipe 119 connected to a return lead-in opening 12*b* of the vessel 12 through a sleeve 120. Further, a cover plate 121 is fixed onto a lower surface of the lower supporting member 113 with bolts to close an opening surface of the muffling chamber 113*b*, and the cover plate 121 has a through hole 121*a* at the center through which a lubricating oil pumping member 122 attached to a lower end portion of the rotating shaft 17 penetrates.

In the present embodiment since high pressure refrigerant gas compressed by the high stage side rotary compressing element 111 is discharged into the muffling chamber 113*b* of the lower supporting member 113, higher accuracy gas seal properties are required as compared with the muffling chamber 112*b* to which intermediate pressure refrigerant gas compressed by the low stage side rotary compressing element 19 is discharged. Thus, as shown in FIG. 7, a concave groove 113*e* is provided on a lower end surface of the bearing portion 113*a* of the lower supporting member 113 in the circumferential direction and an O ring 123 is attached to the concave groove 113*e*, and an annular gasket 124 is interposed in a connection portion between a lower end surface of the lower supporting member 113 in the outer circumferential portion of the muffling chamber 113*b* and the cover plate 121 so that gas sealing is carried out.

Figure 8:
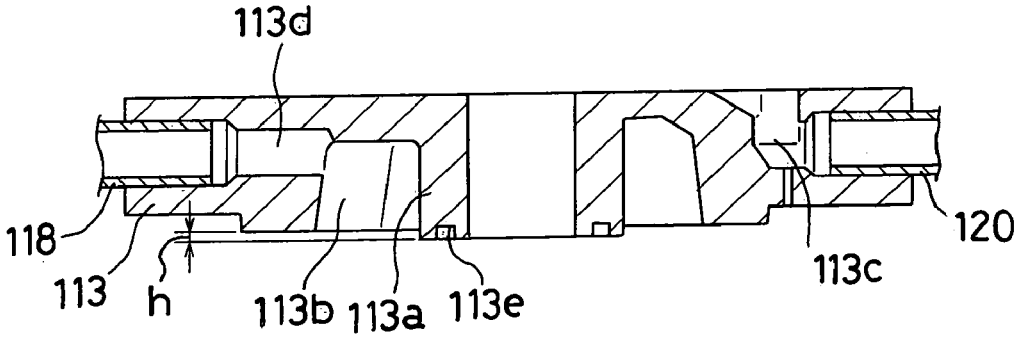
FIG. 8 is a schematic cross-sectional view of the lower supporting member in FIG. 6 in an embodiment in which a gas seal structure according to the present invention is applied to an internal intermediate pressure type two-stage rotary compressor.

In this case, since the concave groove 113*e* is provided on the lower end surface of the thin-walled and short-sized bearing portion 113*a* as shown in FIG. 8, the machining work of the concave groove 113*e* is facilitated. Further, a step h is previously provided between a lower end surface of the bearing portion 113*a* and a lower end surface of the lower supporting member 113 in the outer circumferential portion of the muffling chamber 113*b*. In this case by setting the size of the step h to the same as the thickness of the annular gasket 124 or a little smaller than that, the gasket 124 can be sandwiched at the connection portion between the lower supporting member 113 and the cover plate 121. Consequently, in case where the lower supporting member 113 is formed of a ferrous sintered material for example, the cutting work of the connection portion to the cover plate 121 is not needed. Easy work of the concave grooving and elimination of cutting work allows the machining cost to be reduced. Further, the provision of the step portion improves seal properties and durability. It is noted that as the gasket 124 a metallic gasket is used, but it is not limited thereto and other materials may be used.

Actions of the thus formed internal intermediate pressure type two-stage rotary compressor will be described. When the stator 15*a* of the motor-drive element 15 is energized through the terminal 18, the rotor 15*b* is rotated and the rotary compressing element 16 is driven by the rotation of the rotor 15*b* as well as the rotating shaft 17. Then when low pressure refrigerant gas is introduced through the refrigerant gas lead-in pipe 114 connected to the closed vessel 11, the low pressure refrigerant gas is sucked to the suction port 112*c* of the upper supporting member 112 and passes through the passage 19*c* formed in the cylinder 19*a* of the low stage side rotary compressing element 19 to be sucked into the low pressure chamber from the suction port 12*c*, and the low pressure refrigerant gas is compressed to intermediate pressure by eccentric rotation of the roller 19*b*. The refrigerant gas compressed to the intermediate pressure is discharged to the muffling chamber 112*b* in the upper supporting member 112 from the high pressure chamber in the cylinder 19*a* and is discharged to the inside of the closed vessel 11 through a discharge port (not shown) communicating with the muffling chamber 112*b*.

The intermediate pressure refrigerant gas discharged into the closed vessel 11 is sent to a cooler (not shown) through a discharge pipe (not shown) connected to the discharge opening 12*d* (FIG. 1) formed in the vessel 12 and is cooled in the cooler. After that the intermediate pressure refrigerant gas is led to the suction port 113*c* in the lower supporting member 113 through the refrigerant gas return lead-in pipe 119. The refrigerant gas led in the suction port 113*c* passes through the passage 111*c* formed in the cylinder 111*a* of the high stage side rotary compressing element 111 to be sucked in the low pressure chamber, and is compressed to high pressure by eccentric rotation of the roller 111*b*. The refrigerant gas compressed to high pressure is discharged to the muffling chamber 113*b* in the lower supporting member 113 from the high pressure chamber in the cylinder 111*a* and is discharged from the discharge port 113*d* communicating with the muffling chamber 113*b* to the outside of the closed vessel 11 through the refrigerant gas lead-out pipe 117.

Then the high pressure refrigerant gas discharged outside the closed vessel 11 is supplied to for example a gas cooler in a refrigeration cycle such as an air-conditioner (not shown) and cooled by the gas cooler. After that the refrigerant gas is pressure reduced by an expansion valve and is evaporated by an evaporator, and then it passes through an accumulator and is returned to the compressor from the refrigerant gas lead-in pipe 114.

Next, an embodiment in which a gas seal structure according to the present invention is applied to an internal high pressure type two-stage rotary compressor will be described with reference to FIG. 9. In the embodiment shown in FIG. 9, the same components (even if the position is different the component is substantially the same) as in the embodiment shown in FIG. 6 are shown in the same reference numerals.

Figure 9:
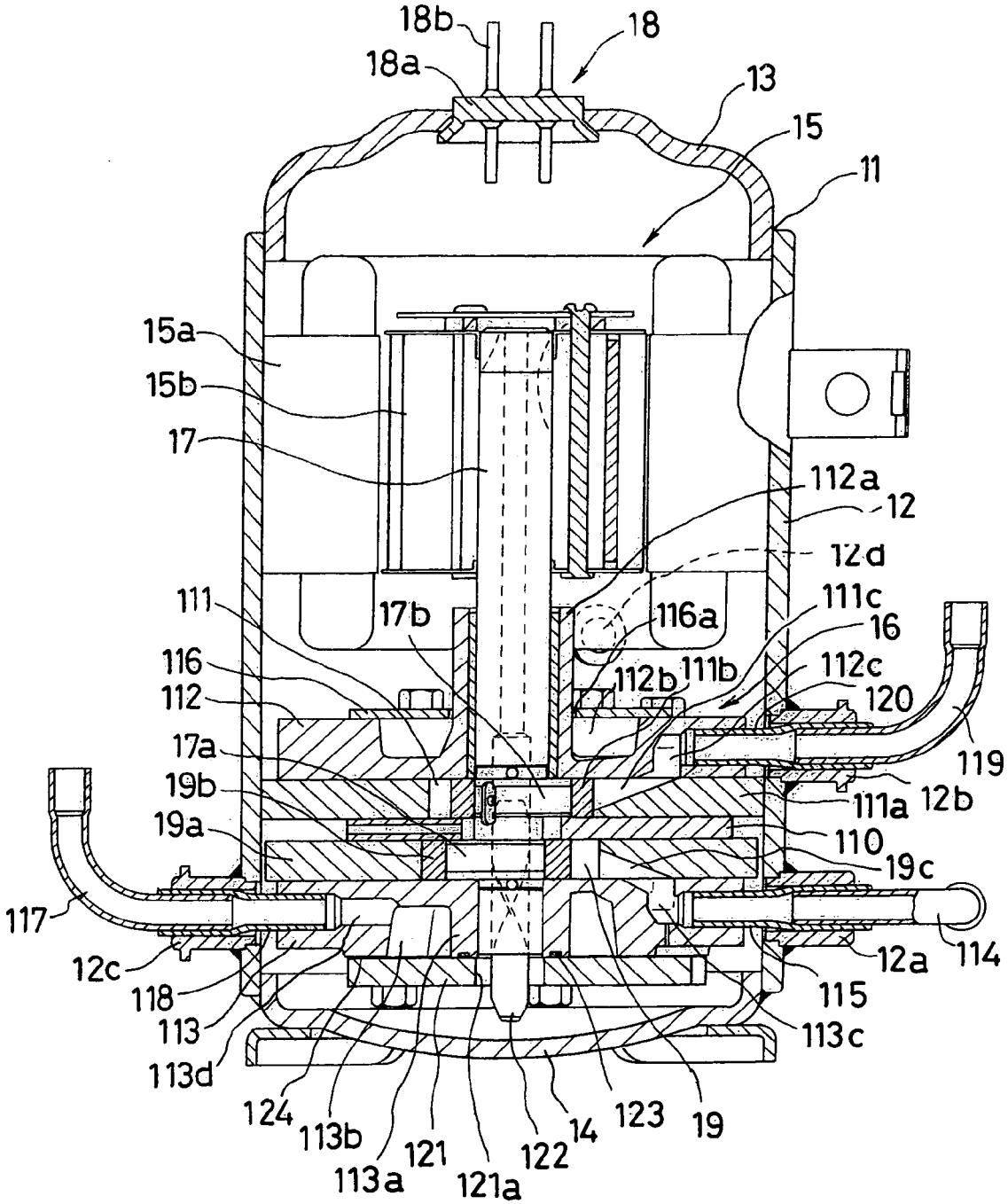
FIG. 9 is a schematic cross-sectional view showing another embodiment in which a gas seal structure according to the present invention is applied to an internal intermediate pressure type two-stage rotary compressor.

In FIG. 9, the reference numeral 11 is a closed vessel. The closed vessel 11 is comprised of a substantially cylindrical vessel 12 and end caps 13, 14 attached to opening end portions of the vessel 12, and is provided in such a manner that a motor-drive element 15 and a rotary compressing element 16 are positioned at upper and lower portions respectively in this closed vessel 11.

The motor-drive element 15 is comprised of an annular stator 15*a* fixed to an inner surface of the vessel 12 and a rotor 15*b*, which rotates inside the stator 15*a*. The rotor 15*b* is journaled on an upper end portion of a rotating shaft 17. This motor-drive element 15 rotates the rotor 15*b* by current feed to the stator 15*a* through a terminal 18 attached to the end cap 13.

The terminal 18 is comprised of a base 18*a* fixed to an mounting hole of the end cap 13 and a plurality of connecting terminals 18*b* provided on the base 18*a* while penetrating through an electrical insulating material such as glass and synthetic resin. Although not shown, lower end portions of the connecting terminals 18*b* are connected to the stator 15*a* of the motor-drive element 15 through internal lead wires, and upper end portions of the connecting terminals 18*b* are connected to an external power source through external lead wires.

The rotary compressing element 16 is comprised of a low stage side rotary compressing element 19 and a high stage side rotary compressing element 111 provided above the low stage side rotary compressing element 19 interposing a partition plate 110 therebetween. In the rotary compressing element 16, the high stage side rotary compressing element 111 is provided on an upper side of the low stage side rotary compressing element 19 so that the two-stage rotary compressing elements of this embodiment has the same positional relationship as a conventional general two-stage rotary compressing element without reversing the upper and lower positions as in the above-mentioned embodiment. The low stage side rotary compressing element 19 includes a cylinder 19*a* and a roller 19*b*, which rotates eccentrically on the inside of the cylinder 19*a* while being fitted to a low stage side eccentric portion 17*a* provided on the rotating shaft 17. Also, the high stage side rotary compressing element 111 includes a cylinder 111*a* and a roller 111*b*, which rotates eccentrically on the inside of the cylinder 111*a* while being fitted to a high stage side eccentric portion 17*b* provided on the rotating shaft 17.

A vane biased by a spring not shown always abuts on an outer circumferential surface of the roller 19*b* of the low stage side rotary compressing element 19 so that the inside of the cylinder 19*a* is defined to a low pressure chamber and a high pressure chamber. Also a vane biased by a spring always abuts on an outer circumferential surface of the roller 11*b* of the high stage side rotary compressing element 111 so that the inside of the cylinder 111*a* is defined to a low pressure chamber and a high pressure chamber. It is noted that the low stage side eccentric portion 17*a* provided on the rotating shaft 17 and the high stage side eccentric portion 17*b* are shifted by a phase of 180° to each other.

Further, on the high stage side rotary compressing element 111 is provided an upper supporting member 112 and below the low stage side rotary compressing element 19 is provided a lower supporting member 113. The upper supporting member 112 and the lower supporting member 113 are integrally fixed to each other by a plurality of through bolts with the high stage side rotary compressing element 111, the partition plate 110 and the low stage side rotary compressing element 19 sandwiched therebetween.

The upper supporting member 112 has a bearing portion 112*a* at the center. The bearing portion 112*a* is formed to be thin in wall thickness and long in size, and fits a sleeve inside to support the rotating shaft 17. On the upper surface side of the upper supporting member 112 is provided a muffling chamber 112*b* along the outer circumference of the bearing portion 112*a*, and the muffling chamber 112*b* communicates with an outlet of a high pressure chamber in the cylinder 111*a* of the high stage side rotary compressing element 111, and at the same time it communicates with a discharge port (not shown) formed in the upper supporting member 112. This discharge port communicates with the inside of the closed vessel 11. Further, a suction port 112*c* is provided in the upper supporting member 112. The suction port 112*c* communicates with an inlet of a low pressure chamber through a passage 111*c* formed in the cylinder 111*a* and at the same time communicates with a refrigerant gas return lead-in pipe 119 connected to a return lead-in opening 12*b* of the vessel 12 through a sleeve 120. Further, a cover plate 116 is fixed onto an upper surface of the upper supporting member 112 with bolts to close an opening surface of the muffling chamber 112*b*, and the cover plate 116 has a through hole 116*a* at the center through which the bearing portion 112*a* penetrates.

In the present embodiment, although high pressure refrigerant gas compressed by the high stage side rotary compressing element 111 is discharged into the muffling chamber 112*b* of the upper supporting member 112, since the high pressure refrigerant gas is discharged into the closed vessel 11, high accuracy gas seal properties are not more required as compared with a case where intermediate pressure refrigerant gas compressed by a conventional low stage side rotary compressing element is discharged. Even if high pressure refrigerant gas is slightly gas-leaked from the muffling chamber 112*b* of the upper supporting member 112, since discharged high pressure refrigerant gas is present in the closed vessel 11, any troubles do not occur. Accordingly, it is not necessary to subject an outer circumference of a thin-walled and long-sized bearing portion 112*a* in the upper supporting member 112 to concave grooving work to attach an O ring thereon. Then even if the upper supporting member 112 is formed of a ferrous sintered material, it is not necessary to apply cutting work to the upper end surface of the upper supporting member 112 and interpose a gasket in a connection portion between the upper supporting member 112 and the cover plate 116. Thus, the conventional concave grooving work on the outer circumference of the thin-walled and long-sized bearing portion 112*a* and cutting work of the upper supporting member 112 are eliminated whereby machining cost reduction can be made.

The lower supporting member 113 has a bearing portion 113*a* at the center, and the bearing portion 113*a* is formed more thickly and shorter in size than in the bearing portion 112*a* of the upper supporting member 112 and supports a lower end portion of the rotating shaft 17 without a sleeve fitted inside. Then on the lower surface side of the lower supporting member 113 is provided a muffling chamber 113*b* along the outer circumference of the bearing portion 113*a*, and the muffling chamber 113*b* communicates with an outlet of a high pressure chamber in the cylinder 19*a* of the low stage side rotary compressing element 19, and at the same time it communicates with a discharge port 113*d* formed in the lower supporting member 113. This discharge port 113*d* communicates with a refrigerant gas lead-out pipe 117 connected to the lead-out opening 12*c* of the vessel 12 through a sleeve 118. Further, a suction port 113*c* is provided in the lower supporting member 113. The suction port 113*c* communicates with an inlet of a low pressure chamber through a passage 19*c* formed in the cylinder 19*a* and at the same time communicates with a refrigerant gas lead-in pipe 114 connected to a lead-in opening 12*a* of the vessel 2 through a sleeve 115. Further, a cover plate 121 is fixed onto a lower surface of the lower supporting member 113 with bolts to close an opening surface of the muffling chamber 113*b*, and the cover plate 121 has a through hole 121*a* at the center through which a lubricating oil pumping member 122 attached to a lower end portion of the rotating shaft 17 penetrates.

In the present embodiment although intermediate pressure refrigerant gas compressed by the low stage side rotary compressing element 19 is discharged into the muffling chamber 113*b* of the lower supporting member 113, discharged high pressure refrigerant gas is present in the closed vessel 11. Thus the gas leak of intermediate pressure refrigerant gas from the muffling chamber 113*b* is inconvenient. Accordingly, higher accuracy gas seal properties are required for the muffling chamber 113*b* in the lower supporting member 113 as compared with the muffling chamber 112*b* in the upper supporting member 112. Thus, as in the above-mentioned embodiment as shown in FIG. 7, a concave groove 113*e* is provided on a lower end surface of the bearing portion 113*a* of the lower supporting member 113 in the circumferential direction and an O ring 123 is attached to the concave groove 113*e*, and an annular gasket 124 is interposed in a connection portion between a lower end surface of the lower supporting member 113 in the outer circumferential portion of the muffling chamber 113*b* and the cover plate 121 so that gas sealing is carried out.

In this case, since the concave groove 113*e* is also provided on the lower end surface of the thick-walled and short-sized bearing portion 113*a* in the circumferential direction as shown in FIG. 8, the machining of the concave groove 113*e* becomes easy. Further, a step h is previously provided between a lower end surface of the bearing portion 113*a* and a lower end surface of the lower supporting member 113. In this case by setting the size of the step h to the same as the thickness of the annular gasket 124 or a little smaller than that, the gasket 124 can be sandwiched in the connection portion between the lower supporting member 113 and the cover plate 121. Consequently, in case where the lower supporting member 113 is formed of a ferrous sintered material for example, the cutting work of the connection portion between the cover plate 121 and the lower supporting member 113 is not needed. Easy work of the concave grooving and elimination of the cutting work allows the machining cost to be reduced. Further, the provision of the step portion improves seal properties and durability of the O ring. It is noted that as the gasket 124 a metallic gasket is used, but it is not limited thereto and other materials may be used.

Actions of the thus formed internal high pressure type two-stage rotary compressor will be described. When the stator 15*a* of the motor-drive element 15 is energized through the terminal 18, the rotor 15*b* is rotated and the rotary compressing element 16 is driven by the rotation of the rotor 15*b* as well as the rotating shaft 17. Then when low pressure refrigerant gas is introduced through the refrigerant gas lead-in pipe 114 connected to the closed vessel 11, the low pressure refrigerant gas is sucked into the suction port 113*c* of the lower supporting member 113 and passes through the passage 19*c* formed in the cylinder 19*a* of the low stage side rotary compressing element 19 to be sucked into the low pressure chamber from the suction port 113*c*, and the low pressure refrigerant gas is compressed to intermediate pressure by eccentric rotation of the roller 19*b*. The refrigerant gas compressed to the intermediate pressure is discharged to the muffling chamber 113*b* in the lower supporting member 113 from the high pressure chamber in the cylinder 19*a* and is discharged from a discharge port 113*d* communicating with the muffling chamber 113*b* to the outside of the closed vessel 11 through the refrigerant gas lead-out pipe 117.

The intermediate pressure refrigerant gas discharged outside the closed vessel 11 is sent to a cooler (not shown) through a discharge pipe (not shown) connected to the refrigerant gas lead-out pipe 117 and is cooled in the cooler. After that the intermediate pressure refrigerant gas is led to the suction port 112*c* in the upper supporting member 112 through the refrigerant gas return lead-in pipe 119. The refrigerant gas led in the suction port 112*c* passes through the passage 111*c* formed in the cylinder 111*a* of the high stage side rotary compressing element 111 to be sucked in the low pressure chamber, and is compressed to high pressure by eccentric rotation of the roller 111*b*. The refrigerant gas compressed to high pressure is discharged to the muffling chamber 112*b* in the upper supporting member 112 from the high pressure chamber in the cylinder 111*a* and is discharged from a discharge port (not shown) communicating with the muffling chamber 112*b* to the inside of the closed vessel 11.

Then the high pressure refrigerant gas discharged inside the closed vessel 11 is taken to the outside of the closed vessel 11 through a discharge pipe (not shown) connected to the discharge opening 12*d* of the vessel 12 and at the same time it is supplied to for example a gas cooler in a refrigeration cycle of such as an air-conditioner (not shown) and cooled by the gas cooler. After that the refrigerant gas is pressure reduced by an expansion valve and is evaporated by an evaporator, and then it passes through an accumulator and is returned to the compressor from the refrigerant gas lead-in pipe 114. The present embodiment is slightly different from the above-mentioned embodiment in pipe arrangement.

The two-stage rotary compressor according to the present invention can be preferably used by incorporating it into an automobile air-conditioner, a domestic air-conditioner, a business air-conditioner and a refrigeration cycle in a refrigerator, a freezer, a vending machine and the like.

What is claimed is:

1. A two-stage rotary compressor disposed in a closed vessel, the compressor comprising:

a motor-drive element disposed in an upper portion of the closed vessel, and having a rotating shaft; and a rotary compressing element disposed in a lower portion of the closed vessel, and driven by the rotating shaft of said motor-drive element, the rotary compressing element including:

a partition plate having a vent hole, a low stage side rotary compressing element that is positioned on an upper side of said partition plate, and a high stage side rotary compressing element that is positioned on a lower side of said partition plate-opposite to said upper side, a discharge path for intermediate pressure refrigerant compressed by the low stage side rotary compressing element, to discharge said refrigerant gas into said closed vessel, an outlet for the intermediate pressure refrigerant gas from the closed vessel to be cooled;

an inlet for the cooled, intermediate pressure refrigerant gas from outside said closed vessel to said high stage side rotary compressing element to be compressed to high pressure;

an outlet for the high pressure refrigerant gas to be discharged outside said closed vessel, and a lower supporting member that is attached to a lower side of said high stage side rotary compressing element away from said partition plate, said lower supporting member having:

a suction port, a bearing portion for supporting a lower end portion of the rotating shaft, which is located for rotation by said motor-drive element at the center of the lower supporting member, a muffling chamber surrounding an outer circumference of the bearing portion and having a surface opening, a cover plate for closing the surface opening of said muffling chamber, and an oil supply hole for providing fluid communication between an oil reservoir on a bottom portion of said closed vessel and the suction port.

2. The two-stage rotary compressor according to claim 1, wherein in said oil supply hole the upper end thereof is opened to the suction port of said lower supporting member and the lower end thereof is opened to a gap formed by a gasket interposed between said lower supporting member and said cover plate.

3. The two-stage rotary compressor according to claim 1, wherein in said oil supply hole the upper end thereof is opened to the suction port of said lower supporting member and the lower end thereof is opened to a concave groove formed in a lower end surface of said lower supporting member.

4. The two-stage rotary compressor according to claim 1, wherein in said oil supply hole the upper end thereof is opened to the suction port of said lower supporting member and the lower end thereof is opened to a cutout portion formed in a lower end surface of said lower supporting member.

5. A method of compressing an intermediate pressure refrigerant gas using a two-stage rotary compressor disposed in a closed vessel, the compressor comprising:

a motor-drive element disposed in an upper portion of the closed vessel, and having a rotating shaft; and a rotary compressing element disposed in a lower portion of the closed vessel and driven by the rotating shaft of said motor-drive element, the rotary compressing element including:

a partition plate having a vent hole, a low stage side rotary compressing element that is positioned on an upper side of said partition plate, and a high stage side rotary compressing element that is positioned on a lower side of said partition plate—opposite to said upper side, a discharge path for intermediate pressure refrigerant compressed by the low stage side rotary compressing element, to discharge said refrigerant gas into said closed vessel, an outlet for the intermediate pressure refrigerant gas from the closed vessel to be cooled, an inlet for the cooled, intermediate pressure refrigerant gas from outside said closed vessel to said high stage side rotary compressing element to be compressed to high pressure, an outlet for the high pressure refrigerant gas to be discharged outside said closed vessel, and a lower supporting member that is attached to a lower side of said high stage side rotary compressing element away from said partition plate, said lower supporting member having:

a suction port, a bearing portion for supporting a lower end portion of the rotating shaft, which is located for rotation by said motor-drive element at the center of the lower supporting member, a muffling chamber surrounding an outer circumference of the bearing portion and having a surface opening, a cover plate for closing the surface opening of said muffling chamber, and an oil supply hole for providing fluid communication between an oil reservoir on a bottom portion of said closed vessel and the suction port;

the method comprising:

compressing the intermediate pressure refrigerant gas in the low stage side rotary compressing element;

discharging said refrigerant gas into said closed vessel;

removing said refrigerant gas from the closed vessel;

cooling said refrigerant gas outside of the closed vessel;

supplying said intermediate pressure refrigerant gas as cooled outside the closed vessel to said high stage side rotary compressing element through the suction port;

compressing said intermediate pressure refrigerant gas to high pressure in said high stage side rotary compressing element;

discharging the high pressure refrigerant gas outside said closed vessel; and lubricating the cylinder of the high stage side rotary compressing element using a differential pressure that is created between the intermediate pressure refrigerant gas as it enters the suction port of said high stage side rotary compressing element and an oil reservoir via said oil supply hole.

6. A method of lubricating a cylinder of a high stage side rotary compressing element of a two-stage rotary compressor, the two-stage rotary compressor having a rotary compressing element that includes:

a partition plate having a vent hole, a low stage side rotary compressing element that is positioned on an upper side of said partition plate, and a high stage side rotary compressing element that is positioned on a lower side of said partition plate—opposite to said upper side, and a lower supporting member that is attached to the lower side of said high stage side rotary compressing element, said lower supporting member being provided with:

a suction port, and an oil supply hole, the method comprising:

providing a fluid path between an oil reservoir and the suction port via the oil supply hole;

supplying an intermediate pressure refrigerant gas to said high stage side rotary compressing element through the suction port disposed in the lower supporting member to create a pressure differential;

drawing oil from said oil reservoir to lubricate said cylinder of said high stage side rotary compressing element using the pressure differential created between said suction port and said oil reservoir via said oil supply hole.

* * * * *